United States Patent [19]

Portass

[11] 4,213,720

[45] Jul. 22, 1980

[54] TENSIONING OF MEMBERS

[75] Inventor: Michael L. Portass, Barrow-in-Furness, England

[73] Assignee: Vickers Limited, London, England

[21] Appl. No.: 939,217

[22] Filed: Sep. 5, 1978

[30] Foreign Application Priority Data

Sep. 5, 1977 [GB] United Kingdom ..... 37050/77

[51] Int. Cl.[2] ..... E21B 43/01

[52] U.S. Cl. ..... 405/195; 166/368

[58] Field of Search ..... 405/195–209; 175/5, 7–9, 27; 166/368; 254/172

[56] References Cited

U.S. PATENT DOCUMENTS

| | | | |
|---|---|---|---|
| 3,158,208 | 11/1964 | Kammerer | 175/27 |
| 3,208,728 | 9/1965 | Parks | 175/27 X |
| 3,687,205 | 8/1972 | Mori | 175/5 X |
| 3,788,073 | 1/1974 | Castela et al. | 175/5 X |
| 3,955,621 | 5/1976 | Webb | 175/7 X |
| 4,047,579 | 9/1977 | Wilckens et al. | 175/7 |

*Primary Examiner*—Dennis L. Taylor

*Attorney, Agent, or Firm*—Larson, Taylor and Hinds

[57] ABSTRACT

A plurality of members such as riser pipes are linked by means of a plurality of cylinders to a frame to which tension is to be applied. Each member is linked to the frame by a separate cylinder and the cylinders are interconnected so that the hydraulic fluid pressures in the cylinders are in a fixed proportion relative to one another.

6 Claims, 2 Drawing Figures

TENSIONING OF MEMBERS

Figure 1:
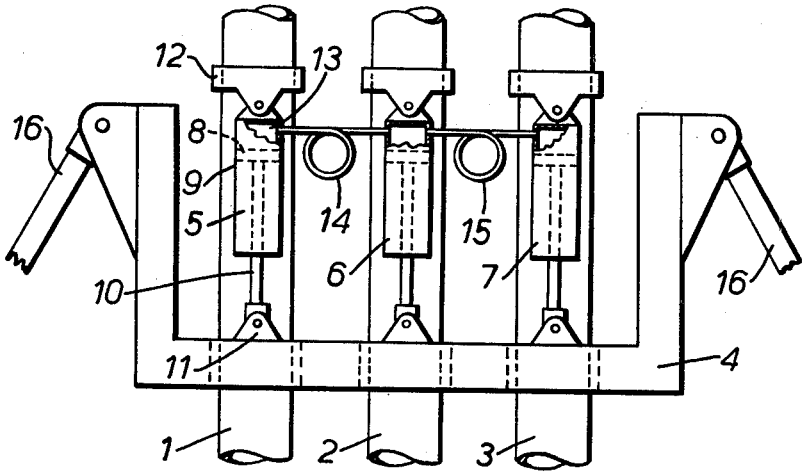

This invention relates to the tensioning of members and more particularly, but not exclusively, is concerned with the tensioning of a plurality of members in the form of a bundle of riser pipes as used when drilling for oil on the seabed or extracting oil from the seabed.

In offshore oil production, some means needs to be provided to convey oil from the seabed to a platform where it may be processed or further conveyed to a tanker or to a shore based installation. In such cases, the oil is conveyed to the platform by a riser pipe. Other riser pipes may extend from the platform down to the seabed to carry processed oil back to a suitable store on the seabed for subsequent delivery to a tanker. Further, other riser pipes may be provided to carry water or other flowable materials between the platform and the seabed. It is convenient to gather these various riser pipes together to form a bundle of pipes which are joined together at intervals by suitable connecting members.

In the case where floating platforms are used, relative movement, both vertically and horizontally, will occur between the platform and the seabed due to the action of waves or tides. Further the bundle will tend to bend as a result of the action of the waves and/or currents etc. Also, pipes carrying oil will tend to be thermally expanded because of the temperature of the oil. Moreover the stresses on the pipes will vary in dependence on the pressure of the material flowing through the pipes. For these reasons therefore it is necessary to allow the pipes in the bundle to move relatively to one another.

Generally, the bundle of pipes is held under tension between the platform and the seabed and it is an object of the present invention to provide an arrangement whereby tension may be applied to a plurality of the pipes in the bundle whilst still allowing axial movement of these pipes relative to one another.

Accordingly the present invention provides, in combination, two or more members (such as a bundle of riser pipes) and an arrangement for applying tension to each of said members, which arrangement comprises:

(i) a frame to which tension is to be applied, and (ii) a plurality of hydraulic cylinders linking the members to the frame, each member being linked to the frame by a separate cylinder and the cylinders being interconnected such that the hydraulic fluid pressures in the cylinders are in a fixed proportion relative to one another.

By means of the arrangement of the present invention, each member carries a fixed proportion of the load when tension is applied to the frame and this proportion is a function of the relative dimensions of the hydraulic cylinders. Within the limits of the strokes of the cylinders, relative axial movement of the individual members in the bundle is possible without any substantial change in the proportion of the load carried by the members.

Each hydraulic cylinder comprises a piston slidable within a casing and defining, with the casing, a chamber containing suitable hydraulic fluid. The piston of the cylinder is linked to the frame or to the member associated with the cylinder and the casing is connected to the member associated with the cylinder or with the frame, as appropriate. The chambers of the various cylinders are linked by a hydraulic line so that there is a fixed relationship between the pressures in each of the chambers. Ordinarily, the pressures in the chambers will be equal to one another in the case where a simple hydraulic interconnection is provided between the chambers. If, however, it is desired for the pressures in the chambers to be different, then a pressure changing device, such as a pressure intensifier or pressure divider may be included in the hydraulic line. In this case the pressures in the chambers concerned will be different to one another but will be in a fixed relation to one another depending upon the characteristics of the intensifier or divider.

The inactive side of the pistons of the cylinders may be oil-filled at atmospheric or low pressure to inhibit corrosion and/or to provide a cushioning effect without restricting the movement of the pistons. Ordinarily, a means will be provided to maintain the volume of hydraulic fluid in the system in the event of any fluid loss by, for example, leakage past the pistons.

Figure 2:
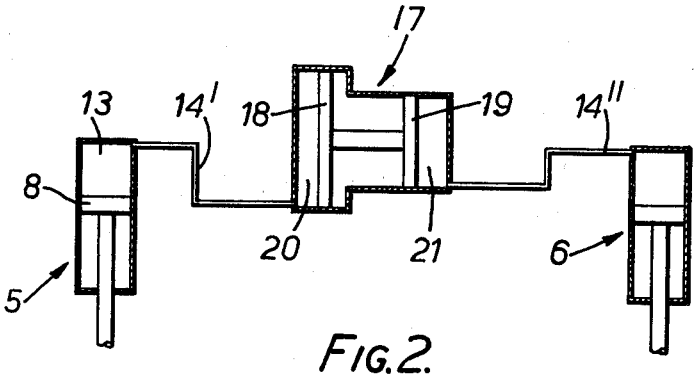

For a better understanding of the invention and to show how the same may be carried into effect, reference will now be made, by way of example, to the accompanying drawing in which:

FIG. 1 is a diagrammatic representation of one embodiment of the arrangement of the present invention, and FIG. 2 is a modified form of a part of the arrangement of FIG. 1.

Referring to FIG. 1, there is shown a part of three members in the form of riser pipes, denoted by reference numerals 1, 2 and 3, and forming a part of a bundle of such pipes extending from the seabed to a floating platform (not shown). There is provided a load distributing device comprising a frame 4 linked to the riser pipes 1, 2 and 3 by three similar hydraulic cylinders denoted generally by reference numerals 5, 6 and 7 respectively. Each of the cylinders comprises a piston 8 axially slidable within a cylindrical casing 9 and pivotally connected by means of a connecting rod 10 to an anchorage 11 on the frame. The casing 9 of each cylinder is pivotally connected to an attachment 12 provided on its respective riser pipe. Each piston 8 defines, together with its associated casing 9, a chamber 13 for hydraulic fluid. The chambers 13 are interconnected by fluid pipes 14 and 15.

Tension is applied to the frame 4 by means of, for example, a tensioner (not shown) in the form of a hydraulic ram having a stroke which is sufficient to cater for the normal relative vertical movement between the floating platform and the bundle of riser pipes and this tension is applied to the frame 4 by means of members 16 pivotally connected to the frame 4.

The load applied to the frame 4 by the tensioner is distributed to each of the three riser pipes in the bundle. However, the interconnection of the chambers of the cylinders by pipes 14 and 15 allows relative movement between the pipes to occur (within the limits of the strokes of the cylinders) without significantly altering the proportion of the total load carried by any single pipe. The loads carried by the individual pipes are proportional to the effective areas of the pistons 8 and, if these are the same as shown, the load applied by the tensioner will be uniformly distributed to each of the pipes.

Referring now to FIG. 2, there is shown a modification of a part of the arrangement of FIG. 1 wherein corresponding parts are denoted by like reference numerals. In this case, instead of there being a simple hydraulic line between chamber 13 of cylinder 5 and chamber 13 of cylinder 6, there is provided a pressure amplifier 17 comprising linked pistons 18 and 19 of different area and slidable in respective casings to form, with the casings, chambers 20 and 21. Chambers 20 and 21 are filled with hydraulic fluid and are linked to chambers 13 of cylinders 5 and 6 respectively by hydraulic lines 14' and 14'' respectively. With an arrangement of this type, the fluid pressure in chamber 13 of cylinder 5 will be different to the fluid pressure in chamber 13 of cylinder 6. These pressures will be in a fixed proportion to one another depending upon the relative dimensions of pistons 18 and 19 and this fixed proportion will be maintained during relative movement of associated riser pipes 1 and 2 within the limits allowed by the strokes of the cylinders 5 and 6.

Although the invention has been particularly described with reference to the case where the members to be tensioned are riser pipes, it will be readily appreciated that the invention is of general application in any instance where it is desired to apply tension to a plurality of members in a manner such that each member carries a predetermined portion of the load and yet is capable of relative axial movement with respect to the other members. If desired, each riser pipe may be linked to the frame by a symmetrically disposed pair of separate cylinders so as to eliminate unwanted bending moments which may occur when only a single cylinder is used for each riser pipe as shown.

I claim:

1. In combination, two or more members capable of relative axial movement with respect to one another and an arrangment for applying tension to each of said members, which arrangement comprises:

(i) a frame to which tension is to be applied, and (ii) a plurality of hydraulic cylinders linking the members to the frame, each member being linked to the frame by a separate cylinder and the cylinders being interconnected hydraulically such that the hydraulic fluid pressures in the cylinders are in a fixed proportion relative to one another and the members are thereby capable of relative axial movement with respect to one another without change in the proportion of the tension carried by the members.

2. The combination of claim 1 wherein the hydraulic fluid pressures in the cylinders are equal.

3. The combination of claim 2 wherein the cylinders are interconnected by means of a simple hydraulic line.

4. The combination of claim 1 wherein the hydraulic fluid pressures in the cylinders are different.

5. The combination of claim 4 wherein the cylinders are interconnected by means of a hydraulic line including a pressure changing device.

6. The combination of claim 1 wherein the members are riser pipes.

* * * * *